US010166652B2

(12) United States Patent
Bae et al.

(10) Patent No.: US 10,166,652 B2
(45) Date of Patent: Jan. 1, 2019

(54) SUBSTRATE POLISHING DEVICE AND METHOD THEREOF

(71) Applicants: KnJ Co., LTD., Asan-si (KR); Samsung Display Co., Ltd., Yongin-si (KR)

(72) Inventors: Gi-Hwan Bae, Hwaseong-si (KR); Jun-Woo Hong, Asan-si (KR)

(73) Assignees: KNJ CO., LTD., Asan-si (KR); SAMSUNG DISPLAY CO., LTD., Gyeonggi-Do (KR)

( * ) Notice: Subject to any disclaimer, the term of this patent is extended or adjusted under 35 U.S.C. 154(b) by 161 days.

(21) Appl. No.: 15/171,363

(22) Filed: Jun. 2, 2016

(65) Prior Publication Data

US 2016/0354895 A1 Dec. 8, 2016

(30) Foreign Application Priority Data

Jun. 4, 2015 (KR) ..... 10-2015-0079436

(51) Int. Cl.
*B24B 37/20* (2012.01)

(52) U.S. Cl.
CPC ..... *B24B 37/20* (2013.01)

(58) Field of Classification Search
CPC ..... B24B 9/10; B24B 37/20
See application file for complete search history.

(56) References Cited

U.S. PATENT DOCUMENTS

2013/0273810 A1* 10/2013 Hsu ..... B24B 9/065 451/5

FOREIGN PATENT DOCUMENTS

| | | | | |
|---|---|---|---|---|
| JP | WO 2016047543 A1 * | 3/2016 | ..... | B24B 9/10 |
| JP | WO 2016047582 A1 * | 3/2016 | ..... | B24B 9/00 |
| KR | 20110081512 A * | 7/2011 | | |
| KR | 20130084759 A * | 7/2013 | | |
| KR | 20130086747 A * | 8/2013 | | |
| KR | 101362242 B1 * | 2/2014 | | |
| WO | WO 2012162223 A1 * | 11/2012 | ..... | B24B 9/08 |
| WO | WO 2014035946 A1 * | 3/2014 | ..... | B24B 1/00 |
| WO | WO 2015070269 A1 * | 5/2015 | ..... | B24B 49/00 |

OTHER PUBLICATIONS

KR 20130084759 A—Jul. 2013—English Machine Translation.*

* cited by examiner

*Primary Examiner* — Marc Carlson

(74) *Attorney, Agent, or Firm* — Cantor Colburn LLP

(57) ABSTRACT

Provided are a device and method for polishing a substrate, in which an upper ground surface, a side surface and a lower ground surface of a substrate can be simultaneously polished, and a polishing wheel can be evenly used on the whole so as to be uniformly abraded. A substrate polishing system is to polish a substrate, of which upper edge and a lower edge are polished, and includes: a table, on which the substrate is secured; a spindle provided at the upper portion of a side surface of the table; a polishing wheel formed in the shape of a cylinder and having a rotating shaft mounted perpendicularly to the substrate, so as to polish the substrate with a side surface thereof while rotating by the spindle; and a Z axis movement means for moving the polishing wheel in the vertical direction during the polishing of the substrate.

14 Claims, 7 Drawing Sheets

SUBSTRATE POLISHING DEVICE AND METHOD THEREOF

BACKGROUND OF THE INVENTION

Field of the Invention

The present invention relates to a device and a method for polishing a substrate after grinding edges of the substrate and, more particularly, to a substrate polishing device and a substrate polishing method, in which the upper ground surface, the side surface and the lower ground surface of a substrate can be simultaneously polished, and a polishing wheel can be evenly used on the whole so as to be uniformly worn.

Background Art

In general, a substrate used as a panel of a flat panel display such as an LCD panel, an OLED panel and the like is cut in a certain size as necessary.

In FIG. 1, (a) and (b) respectively show a substrate A. Referring to (a) and (b) of FIG. 1, the substrate A has sharp edges e1, e2 on the cut surfaces after cutting. These sharp edges e1, e2 are likely to be broken during convey, transfer or processing thereof. Therefore, in order to remove the sharp edges e1, e2, the substrate is subject to abrasion (see (c) of FIG. 1). Furthermore, the substrate A is likely to have defects such as chipping (see "D" in FIG. 1) possibly generated after the cutting of the substrate A and the sharp edges e1, e2 of the substrate have to be removed so as to remove such chipping D and prevent cracks. If the edges of substrate A are ground, an upper ground surface S1 and a lower ground surface S2 are provided as shown in (c) of FIG. 1, wherein a substrate side surface S3 between the upper ground surface S1 and the lower ground surface S2 is also grounded in general.

After grinding the edges e1, e2 as described above, the upper ground surface S1, the lower ground surface S2 and the substrate side surface S3 are additionally polished.

Of course, a polishing process and a grinding process could be carried out together in some cases. However, if the polishing process is carried out together with the grinding process without the above-mentioned edge-removing grinding process, the polishing process has to be carried out more carefully due to the edges. Therefore, it is usual that, after removing the edges by grinding, then the side surface and thus ground edges are polished.

FIG. 2 and FIG. 3 are views for showing a prior art polishing system. Referring to FIG. 2 and FIG. 3, polishing is carried out by rotating a brush 100 in a state, in which a plurality of substrates S are stacked on a table 120.

Explaining more specifically, the substrates are pressed from above by means of a pressing means 121 in the state, in which the substrates are stacked on the table 120. In this state, the brush 100, which is provided beside the substrates is rotated so as to polish the ground surfaces. That is, the substrates are polished through the friction caused by brush hair 110 by the rotation of the brush 100.

The prior art polishing system has a disadvantage that the plurality of substrates S have to be separated one by one after the polishing. In addition, a distance between the substrates S and the brush 100 may be changed continuously such that pressure between the substrates S and the brush 100 may be unlikely to be uniform. Particularly, contact points between the substrates S and the brush 100 are different from each other in terms of direction and angle with respect to a brush rotating shaft and thus the length of the brush hair 100, which touches the substrates S, also becomes different for each of the substrates S. Consequently, the force applied to each of the substrates S by the brush 100 becomes different, resulting in the difference of the polishing quality of each of the substrates S.

Furthermore, if the contact points between the substrates and the brush form different directions and angles with respect to the brush rotating shaft, the positions for supplying slurry from a mounting plate, on which the brush is mounted, to the contact points, at which polishing is carried out, also become different. Therefore, separate slurry injection holes have to be provided in order to uniformly supply the slurry to each of the positions, resulting in the increase of the slurry consumption. In addition, if the slurry supplied from any unnecessary parts is stuck onto the substrate, it could be a burden to the rinsing process of the substrate.

Additionally, according to the configuration of the prior art polishing system described above, a plurality of substrates are stacked together and subject to polishing in such a stacked state. Therefore, it is not possible to process the substrate side surfaces and the edges of the substrates together. Also, if there is a change in the size of the substrates, it could be another burden to the parts required for the stacking of the substrates such that the parts themselves should be changed.

SUMMARY OF THE INVENTION

Accordingly, the present invention has been made to solve the above-mentioned problems occurring in the prior arts, and it is an objective of the present invention to provide a substrate polishing device and a substrate polishing method, in which the upper ground surface, the side surface and the lower ground surface of a substrate can be simultaneously polished.

It is another objective of the present invention to provide a substrate polishing device and a substrate polishing method, in which a polishing wheel can be evenly used on the whole so as to be uniformly worn.

To accomplish the above objectives, according to the present invention, there is provided a substrate polishing system for polishing a substrate, of which an upper edge and a lower edge are polished, comprising: a table, on which a substrate is secured; a spindle provided at the upper portion of a side surface of the table; a polishing wheel formed in the shape of a cylinder and having a rotating shaft mounted perpendicularly to the substrate, so as to polish the substrate with a side surface thereof while rotating by the spindle; and a Z axis movement means for moving the polishing wheel at a predetermined speed in the vertical direction during the polishing of the substrate.

In addition, it is preferable that the polishing wheel has a surface layer made from an elastic material and, when a side surface of the substrate is pressed, the surface layer is elastically deformed and comes into close contact with an upper ground surface and a lower ground surface of the substrate such that the polishing wheel simultaneously polishes the upper ground surface, the lower ground surface and the side surface.

Further, it is preferable that the surface layer of the polishing wheel is made from a material, which contains polyurethane and cerium oxide, and the polishing wheel has a surface hardness of Shore A 70~100.

Furthermore, it is preferable that the substrate polishing system further comprises: an X axis movement means for moving the polishing wheel such that the polishing wheel is moved towards or away from the substrate; an Y axis movement means for moving the table in a direction perpendicular to the movement direction of the polishing wheel by the X axis movement means; and a rotation means for rotating the table.

In another aspect of the present invention, there is provided a substrate polishing method for polishing a substrate, of which an upper edge and a lower edge are ground, comprising the steps of: 1) securing a substrate onto a table; 2) bringing a side surface of a polishing wheel, which is formed in the shape of a cylinder and has a rotating shaft mounted perpendicularly to the substrate, into close contact with an upper ground surface, a side surface and a lower ground surface of the substrate; and 3) rotating the polishing wheel so as to simultaneously polish the upper ground surface, the side surface and the lower ground surface of the substrate.

In addition, it is preferable that, in step 2), a surface layer of the polishing wheel is elastically deformed and comes into close contact with the upper ground surface, the side surface and the lower ground surface of the substrate.

Further, it is preferable that step 3) is carried out while the polishing wheel is moved at a predetermined speed in the vertical direction.

Further, it is possible that step 3) is carried out in such a manner that the sides of the substrate are polished while the substrate is moved in the Y direction.

Furthermore, it is possible that step 3) is carried out in such a manner that the corners of the substrate are polished by rotating the substrate while the polishing wheel is moved in the X axis direction and simultaneously in the Y axis direction.

According to the present invention as described above, the upper ground surface, the side surface and the lower ground surface of a substrate can be simultaneously polished.

Particularly, the polishing wheel can be evenly used on the whole since polishing is carried out while the polishing wheel is moved at a predetermined speed in the vertical direction. Therefore, the polishing wheel is uniformly worn out on the whole, thereby elongating the replacement period of the polishing wheel.

BRIEF DESCRIPTION OF THE INVENTION

BRIEF EXPLANATION OF REFERENCE CHARACTERS

Figure 1:
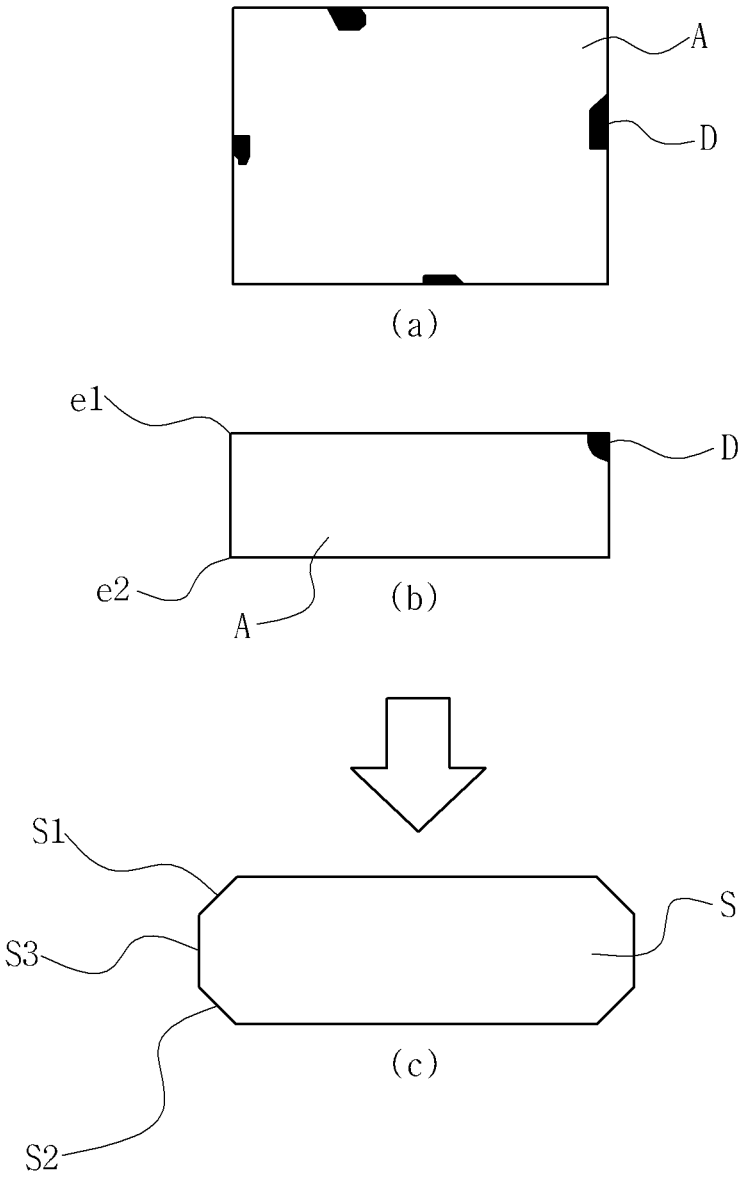
Fig. 1 Prior Art
FIG. 1 is a conceptual diagram for explaining the grinding and polishing processes of a substrate.
Figure 2:
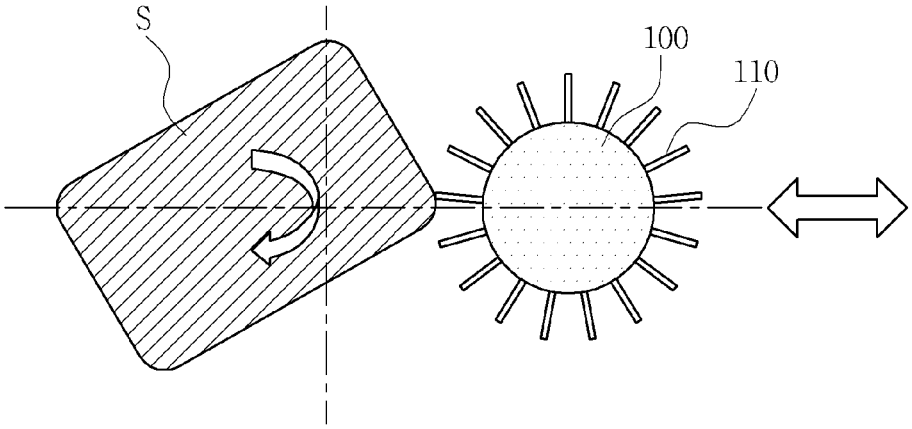
Fig. 2 Prior Art
FIG. 2 and FIG. 3 are views for showing a prior art polishing system.
Figure 3:
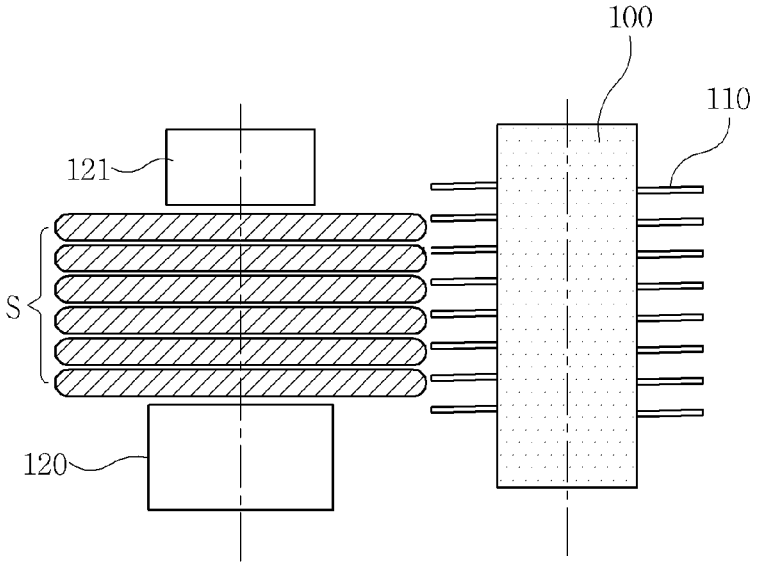
Fig. 3 Prior Art

1: embodiment
10: table
20: rotation means
30: Y axis movement means
40: spindle
50: polishing wheel
60: X axis movement means
70: Z axis movement means

DETAILED DESCRIPTION OF THE PREFERRED EMBODIMENT

Reference will be now made in detail to the preferred embodiments of the present invention with reference to the attached drawings.

Figure 4:
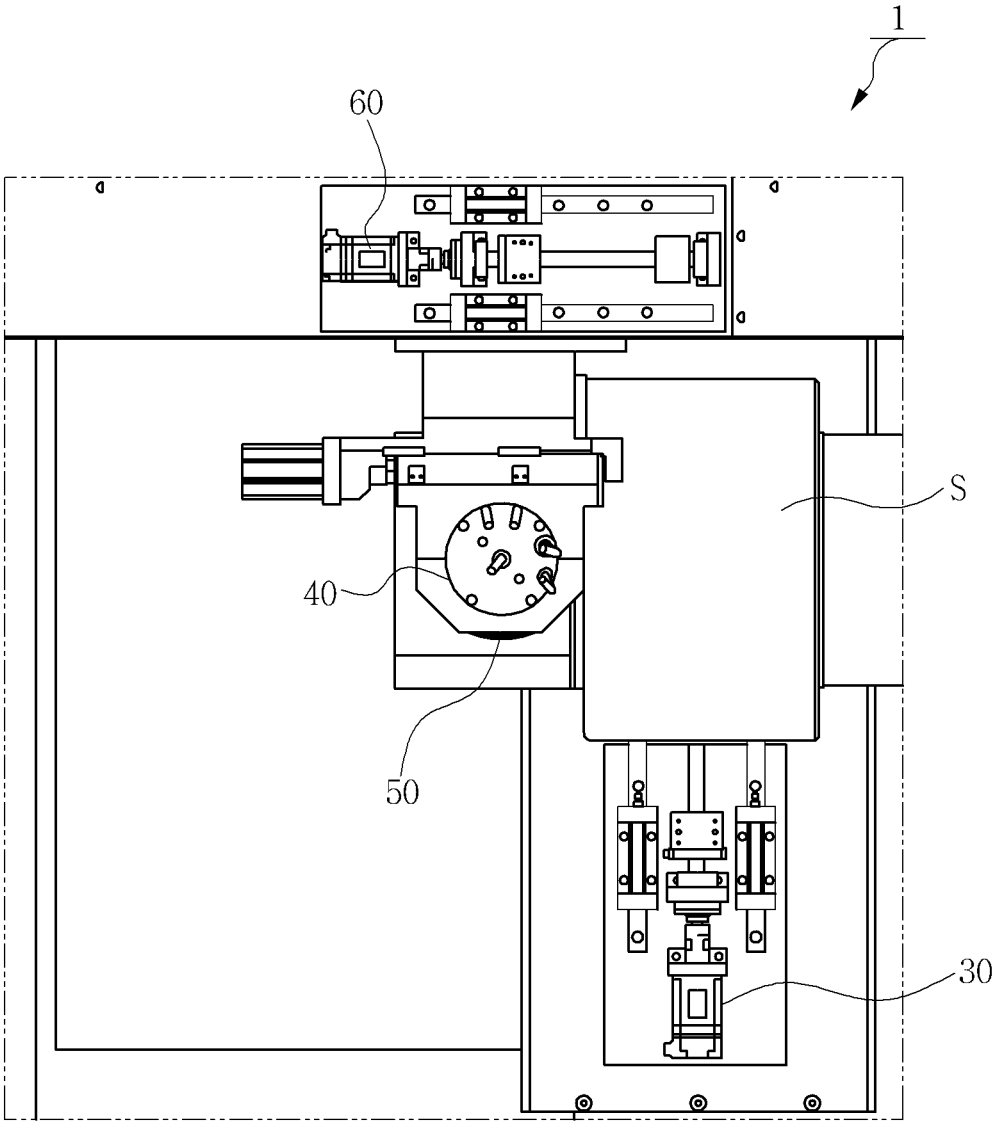
FIG. 4 to FIG. 6 are views for showing the structure of a polishing system according to the present invention.
Figure 5:
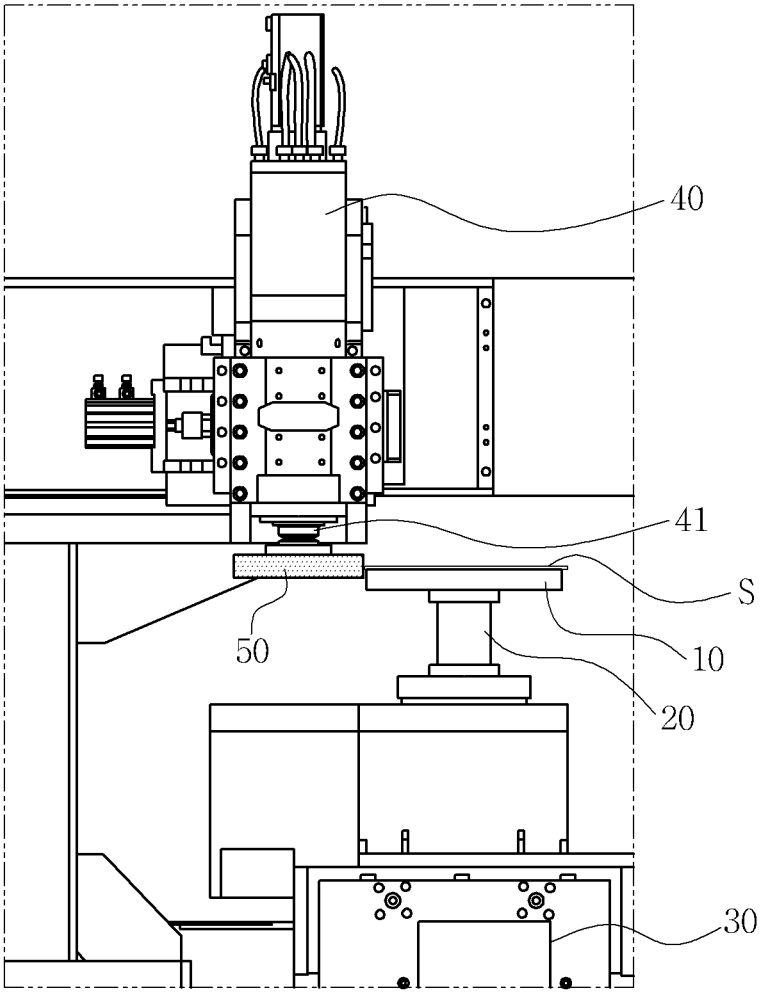

FIG. 4 is a plane view showing a substrate polishing device according to an embodiment 1 of the present invention, and FIG. 5 is a front view of the substrate polishing device. Referring to FIG. 4 and FIG. 5, a substrate polishing device according to an embodiment 1 of the present invention includes a table 10, an Y axis movement means 30, a rotation means 20, a spindle 40, a polishing wheel 50, a Z axis movement means 70 and an X axis movement means 60.

The table 10 is a constituent element for securing a substrate S and has a vacuum hole (not shown) for stably fixing the substrate by vacuum-adsorption. It is also possible to fix the substrate by means of a clamp (not shown). Meanwhile, the term "substrate" refers to all of a glass substrate, a panel or any other object to be processed.

The table 10 is rotatably provided on a rotation means 20 and can also reciprocate in the Y axis direction by the Y axis movement means 30.

The spindle 40 provides driving force for rotating the polishing wheel 50. As shown in FIG. 5, the spindle 40 is provided at an upper portion of a side surface of the table 10 so as to be perpendicular to the rotating shaft 41.

The polishing wheel 50 is a constituent element for polishing the substrate S while rotating, wherein the polishing wheel 50 is connected to the spindle 40 so as to rotate in a state, in which the polishing wheel 50 is in close contact with the substrate S.

The polishing wheel 40 is formed in the shape of a cylinder (could be also identified as a ring shape according to a view point) and may be vertically provided with a rotating shaft 41. That is, the rotating shaft 41 of the polishing wheel 40 polishes the substrate by using the side surface thereof in a state, in which the rotating shaft 41 of the polishing wheel 40 is mounted to be perpendicular to the substrate S.

In addition, the substrate polishing device includes the Z axis movement means 70 and the X axis movement means 60, which respectively move the polishing wheel 50 together with the spindle 40 respectively in the z direction and the x direction. The Z axis movement means 70 enables the polishing wheel 50 to carry out lifting motion in the vertical direction and the X axis movement means 60 moves the polishing wheel 50 in a direction towards or away from the substrate S.

Figure 6:
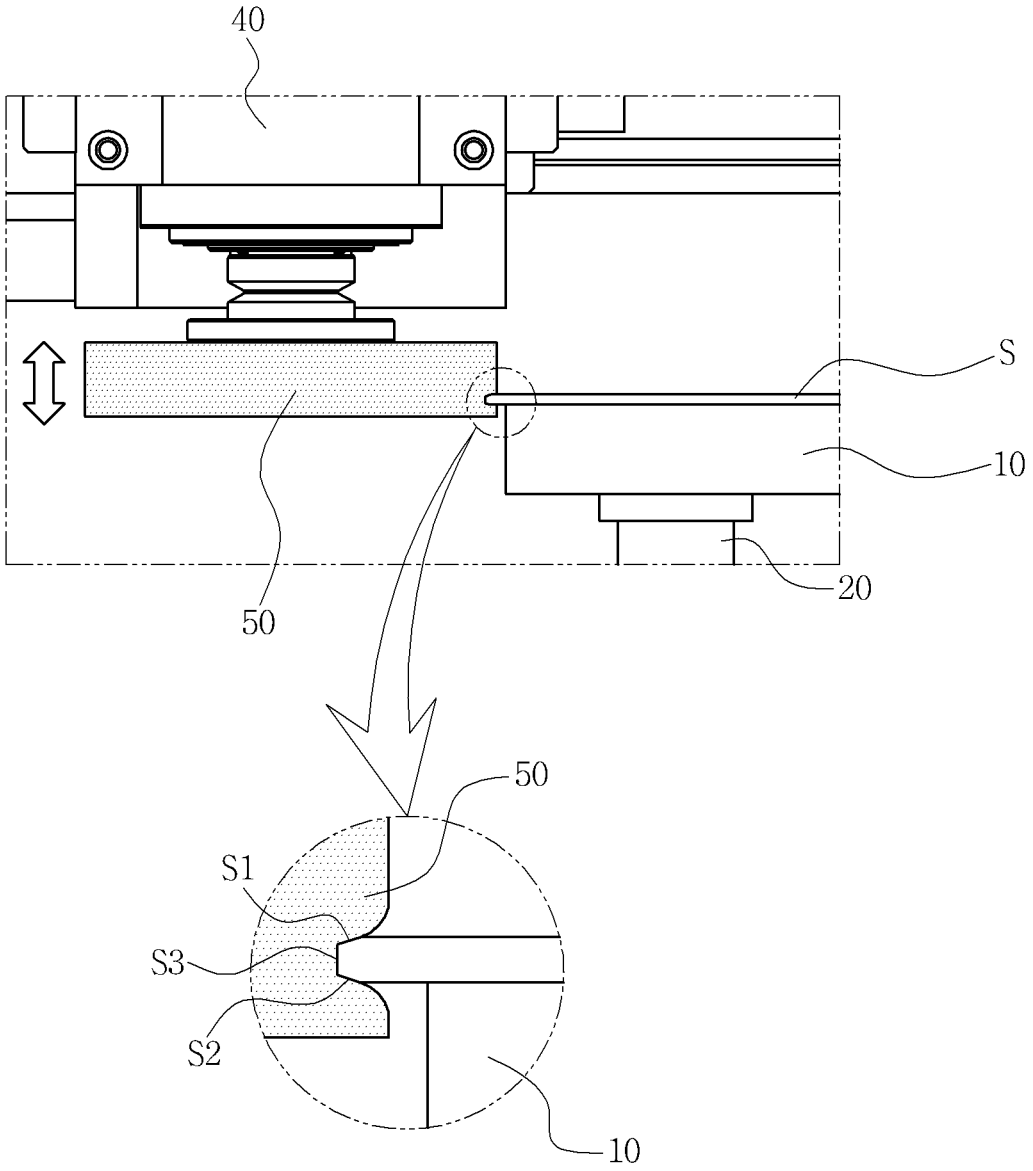

Now, the polishing wheel 50 according to the present invention will be described in more detail with reference to FIG. 6. As shown in FIG. 6, the polishing wheel 50 has a surface layer (processing layer), which is made from an elastic material, such that the surface layer is elastically deformed and thus simultaneously comes into close contact with the upper ground surface S1, the lower ground surface S2 and the side surface S3 of the substrate if the polishing wheel 50 is brought into close contact with the side surface of the substrate S by the X direction movement means ("60" in FIG. 4).

According to the present embodiment, the surface layer of the polishing wheel 50 is made from a material containing polyurethane and cerium oxide so as to have elasticity. Specifically, the surface hardness of the polishing wheel 50 is in the range of Shore A 70~100.

As above, if the polishing wheel is made from an elastic material and pressed against the side surface of the substrate S with predetermined pressure by the axis movement means ("60" in FIG. 4), the side surface of the polishing wheel 50 is elastically deformed and comes into close contact with the side surface S3 of the substrate S as well as the upper ground surface S1 and the lower ground surface S2 thereof. In this state, if the polishing wheel is rotated using the spindle 40, the polishing wheel can simultaneously polish the upper ground surface S1, the lower ground surface and the side surface S3 of the substrate S.

Meanwhile, if the polishing wheel 50 is not moved in the vertical direction but rotated in a state, in which the substrate S is inserted into the side surface of the polishing wheel 50 by a predetermined depth, only the close contact portion of the polishing wheel 50 is seriously worn out. Then, the polishing wheel 50 is non-uniformly worn out such that the polishing wheel 50 has to be replaced with a new one even before the use of the designed service time thereof.

In order to secure the uniform use and uniform abrasion of the polishing wheel 50 throughout the polishing wheel 50 in consideration of this problem, according to the present embodiment, the polishing wheel 50 is moved by the Z axis movement means ("70" in FIG. 5) in the vertical direction (see the arrow in FIG. 6) at a uniform speed during the polishing. Therefore, according to the present embodiment, the polishing wheel 50 can carry out the polishing with uniform abrasion but without the local abrasion.

Hereinafter, the use state of the substrate polishing device according to the present invention and a substrate polishing method according to the present invention will be described in detail with reference to FIG. 7 to FIG. 9.

Figure 7:
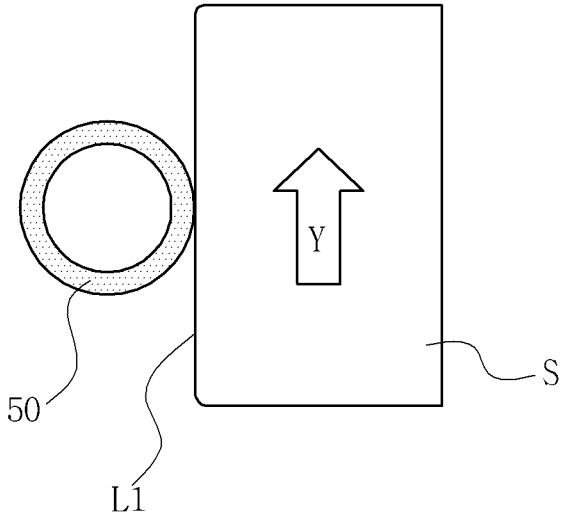
FIG. 7 to FIG. 9 are views for explaining a polishing method according to the present invention.

FIG. 7 shows a substrate polishing method according to the present invention, wherein a side of the substrate S is polished using the substrate polishing device of the present invention. The polishing wheel 50 moves in the substrate direction by using the X axis movement means ("40" in FIG. 4) so as to come into close contact with a first long side L1 of the substrate. Herein, as shown in FIG. 6, the polishing wheel 50 is elastically deformed and comes into close contact not only with the side surface S3 of the first long side L1 of the substrate but also with the upper ground surface S1 and the lower ground surface S2 of the substrate. In this state, the polishing wheel 50 is rotated while moving at a uniform speed in the vertical direction by the Z axis movement means ("70" in FIG. 5). Meanwhile, the substrate S is moved in the Y direction by using the Y axis direction movement means ("30" in FIG. 4) and thus the upper ground surface S1, the lower ground surface S2 and the side surface S3 of the first long side L1 are simultaneously polished.

Figure 8:
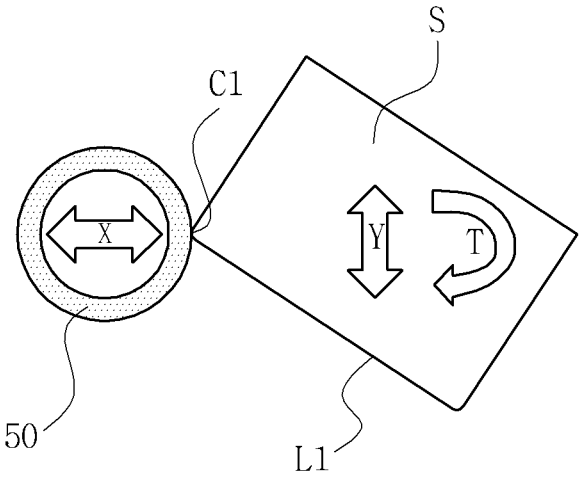

FIG. 8 shows the substrate polishing method according to the present invention, wherein a corner of the substrate S is polished using the substrate polishing device of the present invention. If the polishing of the first long side L1 is finished as shown in FIG. 7, the substrate S is rotated using the rotation means ("20" in FIG. 5) and moved in the Y direction by using the axis direction movement means ("30" in FIG. 4).

Simultaneously, in order to correspond to the rotation of the substrate S, the front portion of a first corner C1 is polished while moving the polishing wheel 50 in a direction away from the substrate by using the X axis movement means ("60" in FIG. 4). If the peak wheel 50 passes the peak of the first corner C1, the rear portion of the first corner C1 is polished while moving the polishing wheel 50 in a direction towards the substrate S by using the X axis movement means again. Of course, the polishing wheel 50 also simultaneously polish the upper ground surface S1, the lower ground surface S2 and the side surface S3 of the first corner C1.

After polishing the first corner C1, a first short side L2 is polished in the same manner. As shown in FIG. 9, the polishing is carried out while moving the substrate S in the Y direction and moving the polishing wheel 50 in the vertical direction in a state, in which the polishing wheel 50 simultaneously comes in contact with the upper ground surface S1, the lower ground surface S2 and the side surface S3 of first short side L2.

Figure 9:
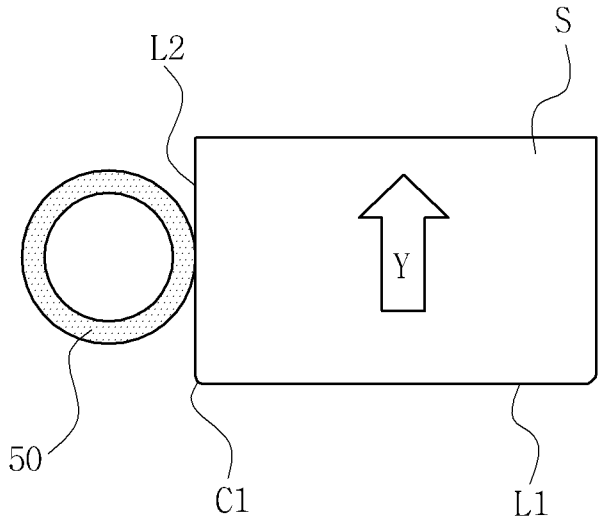

All of the sides and corners of the substrate S can be polished using the single polishing wheel 50 by repeating the procedure shown in FIG. 7 to FIG. 9. That is, the first long side L1, the first corner C1, the first short side L2, a second corner, a second long side, a third corner and a second short side are sequentially polished and then all the polishing procedure is finished (the first long side L1→the first corner C1→the first short side L2→the second corner→the second long side→the third corner→the second short side).

Even though the X axis movement means, the Y axis movement means and the Z axis movement means are formed of air cylinder in the present invention, any other well-known driving means can be also used.

What is claimed is:

1. A substrate polishing system for polishing a substrate, of which an upper edge and a lower edge are polished, comprising:

a table, on which a substrate is secured;

a spindle provided at the upper portion of a side surface of the table;

a polishing wheel formed in the shape of a cylinder and having a rotating shaft mounted perpendicularly to the substrate so as to polish the substrate with a side surface thereof while rotating by the spindle; and a Z axis driver for moving the polishing wheel in the vertical direction during the polishing of the substrate.

2. The substrate polishing system according to claim 1, wherein the polishing wheel has a surface layer made from an elastic material and, when a side surface (S3) of the substrate is pressed, the surface layer is elastically deformed and comes into close contact with an upper ground surface (S1) and a lower ground surface (S2) of the substrate such that the polishing wheel simultaneously polishes the upper ground surface (S1), the lower ground surface (S2) and the side surface (S3).

3. The substrate polishing system according to claim 2, wherein the surface layer of the polishing wheel is made from a material, which contains polyurethane and cerium oxide.

4. The substrate polishing system according to claim 2, wherein the polishing wheel has a surface hardness of Shore A 70~100.

5. The substrate polishing system according to claim 2, comprising an X axis driver for moving the polishing wheel such that the polishing wheel is moved towards or away from the substrate.

6. The substrate polishing system according to claim 5, wherein the X axis driver comprises an air cylinder and the Z axis driver comprises an air cylinder.

7. The substrate polishing system according to claim 5, further comprising:

a Y axis driver for moving the table in a direction perpendicular to the movement direction of the polishing wheel by the X axis driver; and a rotating shaft for rotating the table.

8. The substrate polishing system according to claim 7, wherein the X axis driver comprises an air cylinder, the Y axis driver comprises an air cylinder, and the Z axis driver comprises an air cylinder.

9. The substrate polishing system according to claim 1, wherein the Z axis driver comprises an air cylinder.

10. A substrate polishing method for polishing a substrate, of which an upper edge and a lower edge are polished, comprising:

1) the step of securing a substrate onto a table;

2) the step of bringing a side surface of a polishing wheel, which is formed in the shape of a cylinder and has a rotating shaft mounted perpendicularly to the substrate, into close contact with an upper ground surface (S1), a side surface (S3) and a lower ground surface (S2) of the substrate; and 3) the step of rotating the polishing wheel so as to simultaneously polish the upper ground surface (S1), the side surface (S3) and the lower ground surface (S2) of the substrate, wherein step 3) is carried out while the polishing wheel is moved in the vertical direction, the substrate is moved in a Y axis direction, the Y axis direction being perpendicular to the vertical direction, or the polishing wheel is moved in an X axis direction and the substrate is simultaneously moved in the Y axis direction, the X axis direction being perpendicular to the vertical direction and the Y axis direction.

11. The substrate polishing method according to claim 10, wherein, in step 2), a surface layer of the polishing wheel is elastically deformed and comes into close contact with the upper ground surface (S1), the side surface (S3) and the lower ground surface (S2) of the substrate.

12. The substrate polishing method according to claim 10, wherein step 3) is carried out while the polishing wheel is moved in the vertical direction.

13. The substrate polishing method according to claim 10, wherein step 3) is carried out in such a manner that the sides of the substrate are polished while the substrate is moved in the Y axis direction.

14. The substrate polishing method according to claim 10, wherein step 3) is carried out in such a manner that the corners of the substrate are polished by rotating the substrate while the polishing wheel is moved in the X axis direction and the substrate is simultaneously moved in the Y axis direction.

* * * * *